US006951204B2

(12) United States Patent
Shafer et al.

(10) Patent No.: US 6,951,204 B2
(45) Date of Patent: Oct. 4, 2005

(54) HYDRAULIC FUEL INJECTION SYSTEM WITH INDEPENDENTLY OPERABLE DIRECT CONTROL NEEDLE VALVE

(75) Inventors: Scott F. Shafer, Morton, IL (US); Alan R. Stockner, Metamora, IL (US); Norval J. Wiemken, Dwight, IL (US); Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 48 days.

(21) Appl. No.: 10/637,452

(22) Filed: Aug. 8, 2003

(65) Prior Publication Data

US 2005/0028788 A1 Feb. 10, 2005

(51) Int. Cl.[7] ..... F02M 1/00
(52) U.S. Cl. ..... 123/445; 239/585.1; 239/533.2
(58) Field of Search ..... 123/446; 239/585.1, 239/585.2, 585.5, 533.2

(56) References Cited

U.S. PATENT DOCUMENTS

| | | | | |
|---|---|---|---|---|
| 4,440,132 A | | 4/1984 | Terada et al. | |
| 4,471,740 A | | 9/1984 | Jourde et al. | |
| 4,957,085 A | | 9/1990 | Sverdlin | |
| 5,143,291 A | * | 9/1992 | Grinsteiner | 239/88 |
| 5,413,076 A | | 5/1995 | Koenigswieser et al. | |
| 5,622,152 A | | 4/1997 | Ishida | |
| 5,651,345 A | | 7/1997 | Miller et al. | |
| 5,826,802 A | | 10/1998 | Anderson et al. | |
| 5,878,720 A | | 3/1999 | Anderson et al. | |
| 5,931,139 A | | 8/1999 | Mack | |
| 6,024,296 A | * | 2/2000 | Wear et al. | 239/88 |
| 6,173,699 B1 | | 1/2001 | Kasen | |
| 6,453,875 B1 | | 9/2002 | Mahr et al. | |
| 6,494,383 B2 | * | 12/2002 | Augustin | 239/124 |
| 6,745,958 B2 | * | 6/2004 | Lei | 239/585.2 |
| 6,769,635 B2 | * | 8/2004 | Stewart et al. | 239/558 |

FOREIGN PATENT DOCUMENTS

| | | |
|---|---|---|
| WO | WO 00/23704 | 4/2000 |

* cited by examiner

*Primary Examiner*—John T. Kwon
(74) *Attorney, Agent, or Firm*—Liell & McNeil

(57) ABSTRACT

A common rail fuel injection system addresses three basic issues involving all common rail fuel injection systems. These include high performance, low variability and high efficiency. These issues are addressed by combining pressure intensification with a three way needle control valve, which exhibits substantial leakage only durring a brief instant when the valve is moving between seats. A quick acting needle control valve tightly coupled to a responsive direct control needle valve, as modified by relative timing with a flow control valve, can produce a wide variety of fuel injection rate shapes, including up to five or more discrete injections per engine cycle.

38 Claims, 9 Drawing Sheets

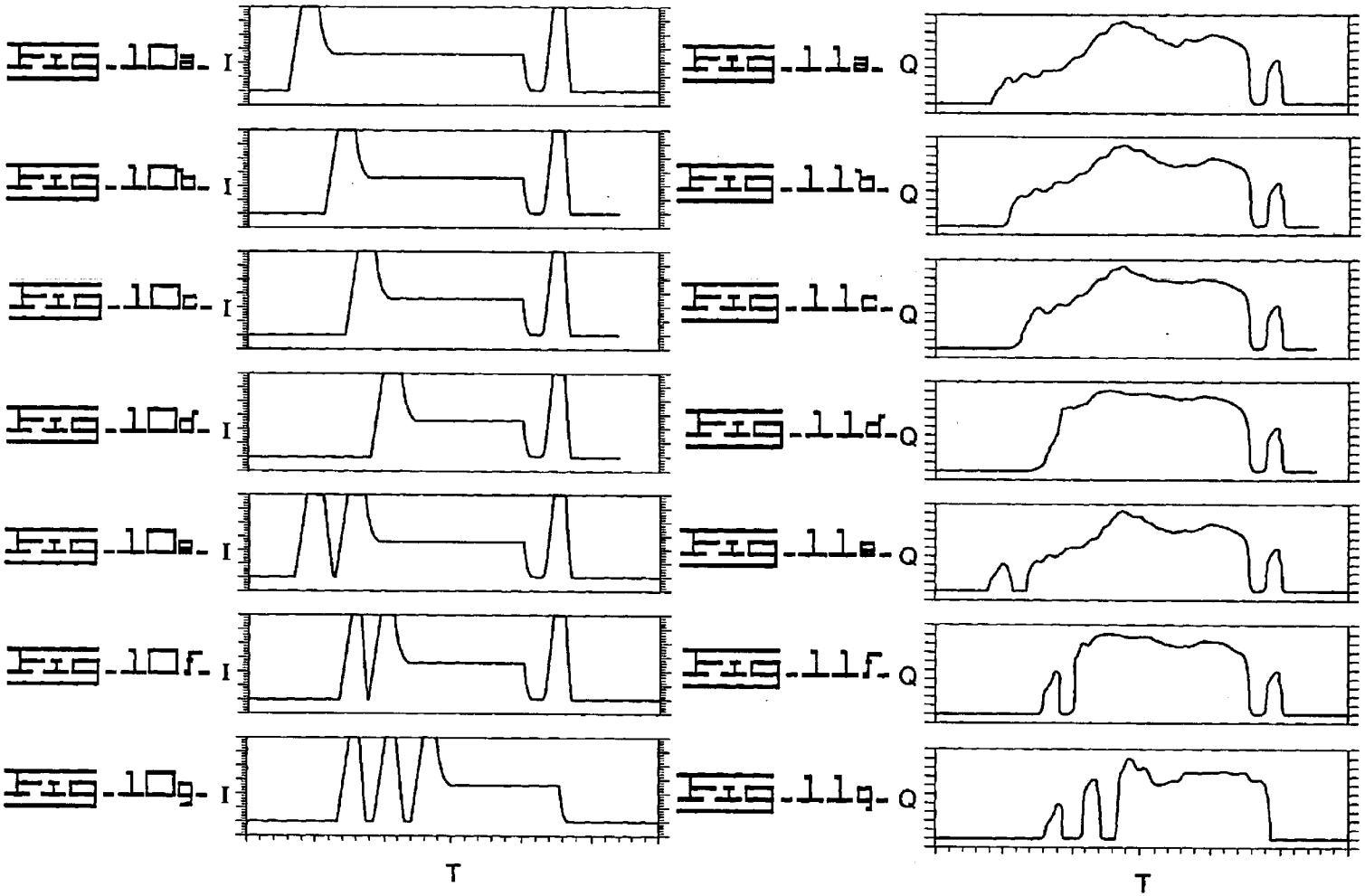
Fig.10a. I
Fig.10b. I
Fig.10c. I
Fig.10d. I
Fig.10e. I
Fig.10f. I
Fig.10g. I
T
Fig.11a. Q
Fig.11b. Q
Fig.11c. Q
Fig.11d. Q
Fig.11e. Q
Fig.11f. Q
Fig.11g. Q
T

HYDRAULIC FUEL INJECTION SYSTEM WITH INDEPENDENTLY OPERABLE DIRECT CONTROL NEEDLE VALVE

TECHNICAL FIELD

The present invention relates generally to common rail fuel injection systems, and more particularly to hydraulically actuated fuel injection systems with direct control needle valves.

BACKGROUND

Engineers are constantly seeking ways to reduce undesirable engine emissions. One strategy is to seek ways to improve performance of fuel injection systems. Over the years, engineers have come to learn that engine emissions can be a significant function of injection timing, the number of injections, injection quantities and rate shapes. However, it is also been observed that an injection strategy at one engine operating condition may decrease emissions at that particular operating condition, but actually produce an excessive amount of undesirable emissions at a different operating condition. Thus, for a fuel injection system to effectively reduce emissions across an engine's operating range, it must have the ability to produce several different rate shapes, have the ability to produce multiple injections and produce injection timings and quantities with relatively high accuracy. Providing a fuel injection system that can perform well with regard to all of these different parameters over an entire engine's operating range has proven to be elusive.

Apart from addressing rate shapes, timing accuracy and quantity accuracy, etc., other issues should be addressed. For instance, in order to be commercially viable, fuel injection systems should not only exhibit superior performance but should also provide for efficient operation. In addition, there should also be the ability to mass produce fuel injection system components, such as unit injectors, with acceptable performance deviations from one another. Thus, in order to present a commercially viable fuel injection system it should satisfy stringent emissions requirements, address a number of problems associated with a relatively wide array of performance capabilities combined with acceptable injector to injector performance variations, and further should exhibit competitive operational efficiencies.

One apparent attempt to satisfy at least some forthcoming performance demands is disclosed in "Heavy Duty Diesel Engines—The Potential of Injection Rate Shaping for Optimizing Emissions and Fuel Consumption", presented by Messrs. Bernd Mahr, Manfred Dürnholz, Wilhelm Polach, and Hermann Grieshaber, Robert Bosch GmbH, Stuttgart, Germany, at the 21st International Engine Symposium, May 4–5, 2000, Vienna, Austria. This reference teaches a common rail system and a directly controlled fuel injector that purportedly has the ability to inject medium pressure fuel directly from the rail, or utilize the common rail to pressure intensify fuel within the injectors for injection at relatively high pressures. While this system may have the ability to exhibit some improved performance characteristics, it appears to suffer from a number of drawbacks. Among these are the fact that the system relies upon circulating medium pressure fuel around an engine and always maintaining the fuel injectors in a pressurized state, which results in continuous leaking and efficiency degradation. In addition, the system appears to employ a two way direct control needle valve that temporarily opens the high pressure rail directly to the drain via a flow restriction during each injection event, resulting in a substantial amount of fuel being expended for no apparently useful purpose. The Bosch system likely suffers from other drawbacks, but most of those limitations lie hidden due to the limited disclosure of the system at this time.

The present invention is directed to one or more of the problems set forth above.

SUMMARY OF THE INVENTION

In one aspect, a fuel injector has an injector body with an upper portion and a lower portion. A pressure intensifier is movably positioned in the upper portion, and a flow control valve is attached to the upper portion. A direct control needle valve is positioned in the lower portion, and an electrical actuator is attached to the lower portion. A three way needle control valve is positioned in the lower portion and operably coupled to the electrical actuator.

In another aspect, a fuel injection system includes a plurality of fuel pressurization assemblies and direct control nozzle assemblies. A pressure intensifier is moveably positioned in each of the fuel pressurization assemblies. A flow control valve is attached to each of the fuel pressurization assemblies. A pressure intensifier is moveably positioned in each of the fuel pressurization assemblies. A common rail is fluidly connected to each of the fuel pressurization assemblies. An electrical actuator is attached to each of the direct control nozzle assemblies. A three way needle control valve is positioned is each of the direct control nozzle assemblies and operably coupled to the electrical actuator.

In still another aspect, a method of injecting fuel includes a step of positioning a needle control valve in a first position that fluidly connects a needle control chamber to a fuel pressurization chamber, and fluidly blocks the needle control chamber to a low pressure passage. The fuel pressure within the fuel pressurization chamber is increased at least in part by moving a flow control valve to a first position. A needle control valve is moved to a second position that fluidly connects the needle control chamber to a low pressure passage, and fluidly blocks the needle control chamber to the fuel pressurization chamber at least in part by supplying electrical energy to a direct control nozzle assembly. Fuel pressure is decreased within the fuel pressurization chamber at least in part by moving the flow control valve to a second position.

BRIEF DESCRIPTION OF THE DRAWINGS

FIG. 10*a*–10*g* are exemplary graphs of needle control valve current verses time for seven example injection profiles according to an aspect of the present invention;

FIGS. 11*a*–11*g* are graphs of fuel injection rate verses time for the seven example injection sequences of FIG. 10*a*–10*g*, respectively.

DETAILED DESCRIPTION

Figure 1:
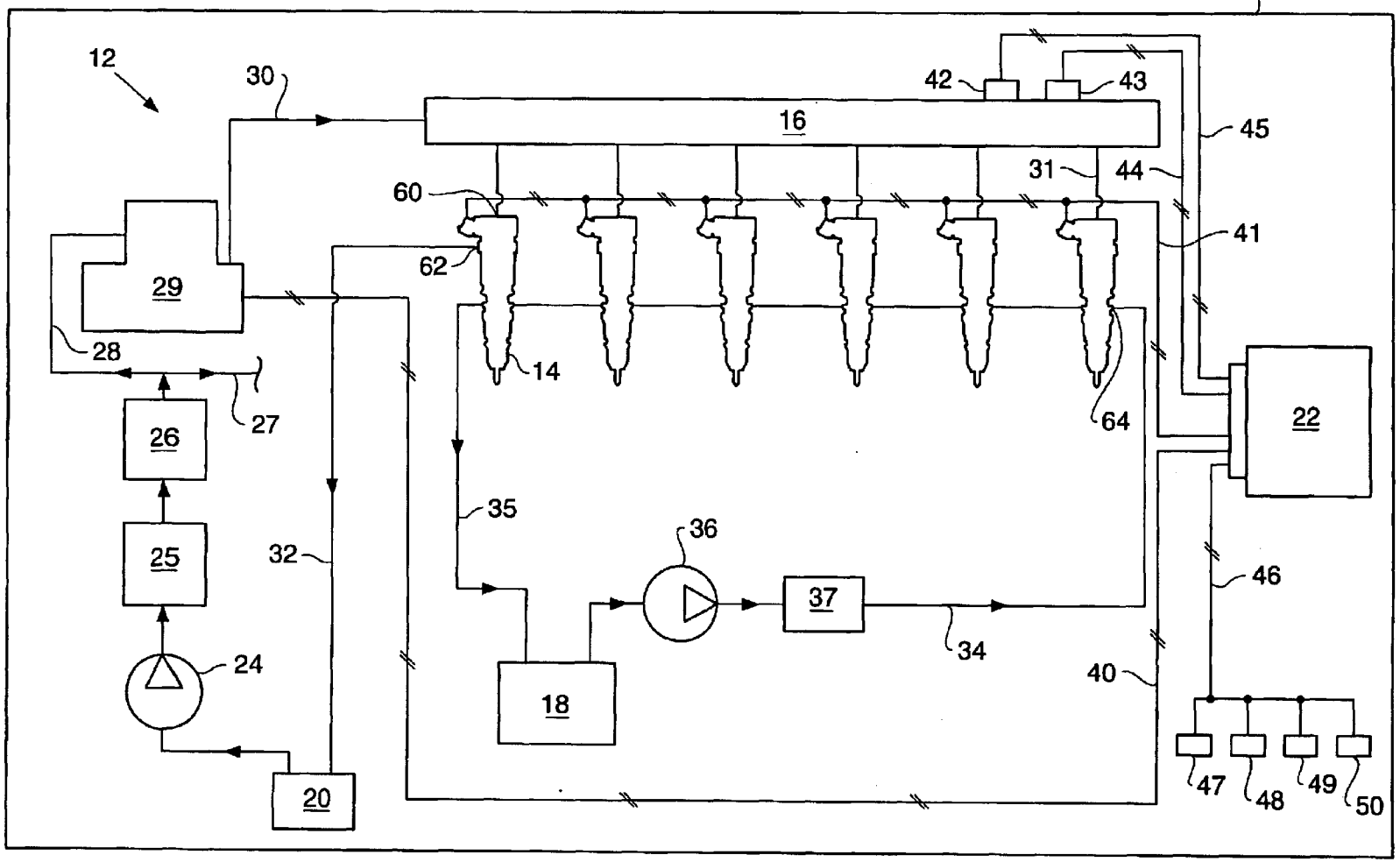
FIG. 1 is a schematic of a fuel injection system according to an embodiment of the present invention.

Referring to FIG. 1, a six cylinder diesel engine 10 includes a common rail fuel injection system 12. The system includes an individual fuel injector 14 for each engine cylinder, a single common rail 16, an oil sump 20 fluidly connected to the common rail 16, and a fuel tank 18 on a separate fluid circuit. Those skilled in the art will appreciate that in other applications there may be two or more separate common rails, such as a separate rail for each side of a "V " engine. An electronic control module 22 controls the operation of fuel injection system 12. The electronic control module 22 preferably utilizes advanced strategies to improve accuracy and consistency among the fuel injectors 14 as well as pressure control in common rail 16. For instance, the electronic control module 22 might employ electronic trimming strategies individualized to each fuel injector 14 to perform more consistently. Consistent performance is desirable in the presence of the inevitable performance variability responses due to such causes as realistic machining tolerance associated with the various components that make up the fuel injectors 14. In another strategy, the electronic control module 22 might employ a model based rail pressure control system that breaks up the rail pressure control issue into one of open loop flow control coupled with closed loop error and pressure control. In other control strategies, fuel temperature may be compensated for each injector, based on a fuel temperature algorithm.

When fuel injection system 12 is in operation, oil is drawn from oil sump 20 by a low pressure oil circulation pump 24, and the outlet flow is split between an engine lubrication passage 27 and a low pressure fuel injection supply line 28 after passing through an oil filter 25 and a cooler 26. The oil in engine lubrication passage 27 travels through the engine and lubricates its various components in a conventional manner. The oil in low pressure supply line 28 is raised to a medium pressure level by a high pressure pump 29. This "medium pressure " is a relatively high pressure compared to oil drain and fuel supply pressures, but still lower than peak injection pressures. Pump 29 is preferably an electronically controlled variable delivery pump, such as a sleeve metered fixed displacement variable delivery pump. High pressure pump 29 is connected to common rail 16 via a high pressure supply line 30. Each of the individual fuel injectors 14 have an actuation fluid inlet 60 connected to common rail 16 via a separate branch passage 31. After being used within individual fuel injectors 14 to pressurize fuel, the oil leaves fuel injectors 14 via an actuation fluid drain 62 and returns to oil sump 20 for recirculation via a return line 32.

Fuel is drawn from a fuel tank 18 by a fuel transfer pump 36 and circulated among fuel injectors 14 via a fuel supply line 34 after passing through a fuel filter 37. Fuel transfer pump 36 is preferably a constant flow electric pump with a capacity sized to meet the maximum demands for engine 10. Also, fuel transfer pump 36 and fuel filter 37 are preferably contained in a common housing. Any fuel not used by the fuel injectors 14 is recirculated to fuel tank 18 via fuel return line 35. Fuel in the fuel supply and return lines 34 and 35 are at a relatively low pressure relative to that in common rail 16, which contains pressurized oil. In other words, fuel injection system 12 includes no high pressure fuel lines. and the fuel is pressurized to injection levels within each individual fuel injector 14, and then usually for only a brief period of time during an injection sequence.

Fuel injection system 12 is controlled in its operation via an electronic control module 22 via control communication lines 40 and 41. Control communication line 40 communicates with high pressure pump 29 and controls its delivery, and hence the pressure in common rail 16. Control communication lines 41 include four wires, one pair for each electrical actuator within each fuel injector 14. Those skilled in the art will appreciate that by modifying control signals, a single pair of wires could be used to control two electrical actuators. In addition, there may be more wires, such as for carrying feedback signals to the electronic control module. These respective actuators within fuel injectors 14 control flow of actuation fluid to the injectors from rail 16, and the opening and closing of the fuel injector spray nozzle. Electronic control module 22 determines its control signals based upon various sensor inputs known in the art. These include an oil pressure sensor 42 attached to rail 16 that communicates an oil pressure signal via sensor communication line 45. In addition, an oil temperature sensor 43, which is also attached to rail 16, communicates an oil temperature signal to electronic control module 22 via a sensor communication line 44. In addition, electronic control module 22 receives a variety of other sensor signals via a sensor communication line(s) 46. These sensors could include but are not limited to, a throttle sensor 47, a timing sensor 48, a boost pressure sensor 49 and a speed sensor 50.

Figure 2:
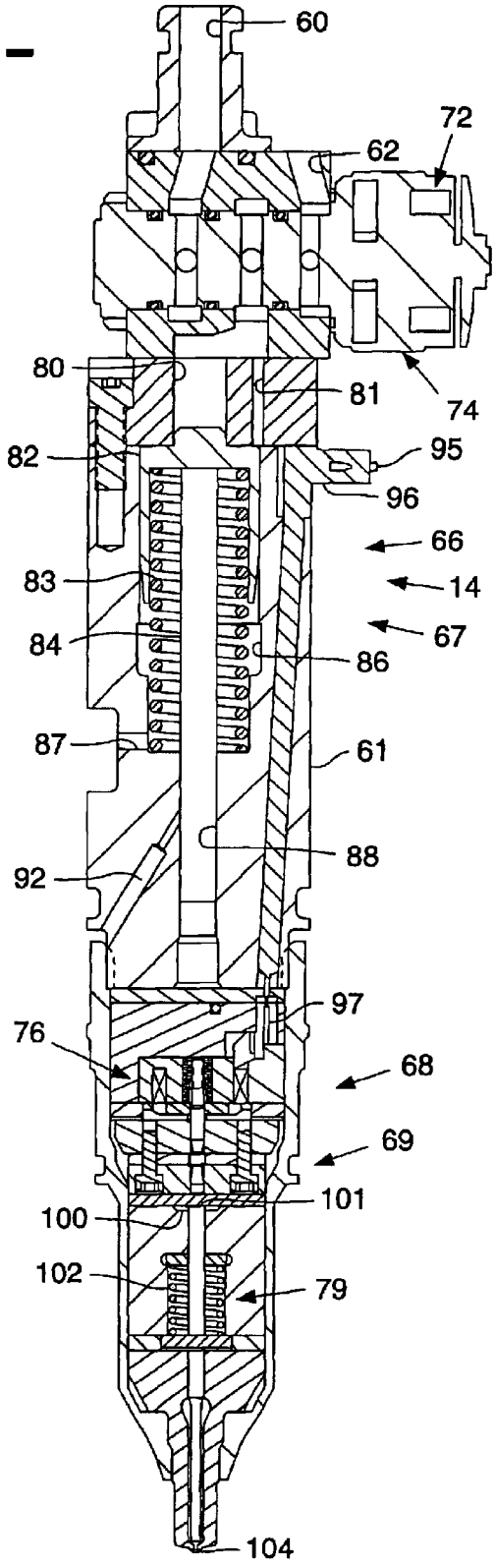
FIG. 2 is a sectioned side diagrammatic view of a fuel injector according to an embodiment of the present invention.
Figure 3:
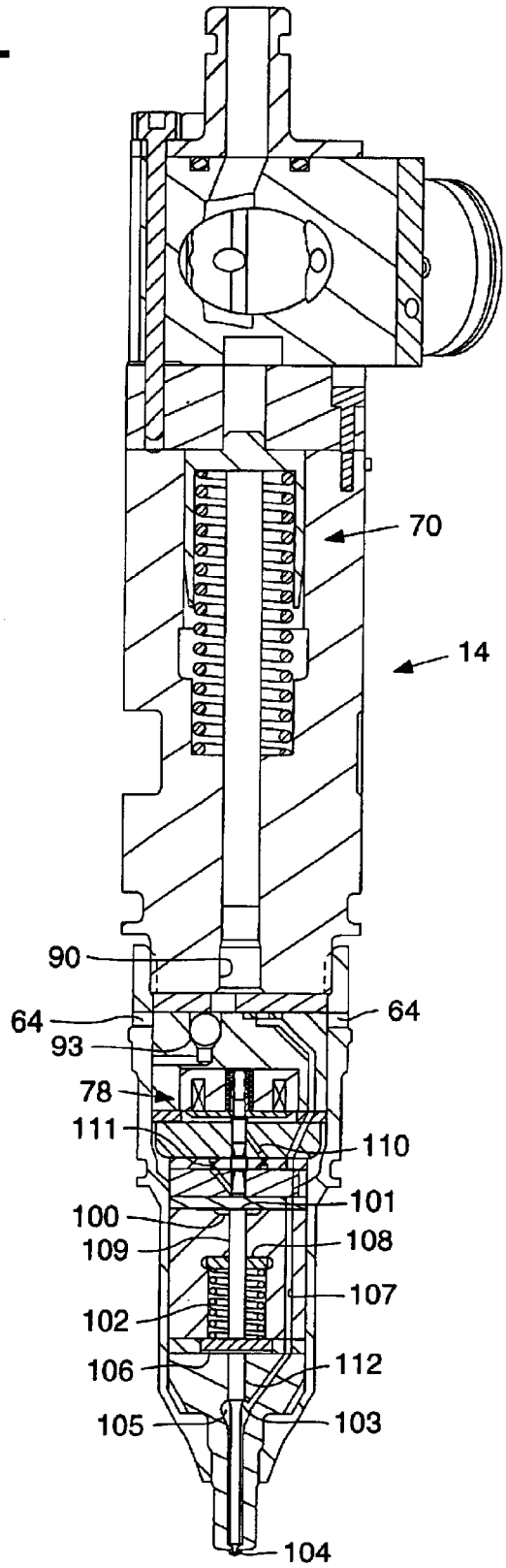
FIG. 3 is the fuel injector of FIG. 2 as viewed along a different section line.

Referring in addition to FIGS. 2 and 3, each fuel injector 14 includes an injector body 61 that can be thought of as including an upper portion 66 and a lower portion 68. Fuel injector 14 can also be thought of as being divided between fuel pressurization assembly 67 and a direct control nozzle assembly 69. In the fuel injector 14 illustrated, fuel pressurization assembly 67 is located in upper portion 66, whereas direct control nozzle assembly 67 is located in lower portion 68. Although the fuel injector 14 shows the fuel pressurization assembly 67 and the direct control nozzle assembly 69 joined into a unit injector 14, those skilled in the art will appreciate that those respective assemblies could be located in separate bodies connected to one another with appropriate lines. The fuel pressurization assembly 67 includes a pressure intensifier 70 and a flow control valve 74, which is operably coupled to an electrical actuator 72. Direct control nozzle assembly 69 includes a needle control valve assembly 76 that is operably coupled to an electrical actuator 78, which is located in and attached to lower portion 68. In addition, a direct control needle valve 79 is controlled in its opening and closing by needle control valve assembly 76, and hence electrical actuator 78. Pressurized oil enters injector body 61 through its top surface at actuation fluid inlet 60, and used low pressure oil is recirculated back to the sump 24 via an actuation fluid drain 62. Fuel is circulated among the lower portions 68 of fuel injectors 14 via fuel inlets 64.

Pressure intensifier 70 includes a stepped top intensifier piston 82 and preferably a free floating plunger 84. Intensifier piston 82 is biased to its retracted position, as shown, by a return spring 83. The stepped top of intensifier piston 82 allows the initial movement rate, and hence possibly the initial injection rate, to be lower than that possible when the stepped top clears a counter bore. Return spring 83 is positioned in a piston return cavity 86, which is vented directly to the area underneath the engine's valve cover via an unobstructed vent passage 87. Free floating plunger 84 is biased into contact with the underside of intensifier piston 82 via low pressure fuel acting on one end in fuel pressurization chamber 90. Plunger 84 preferably has a convex end in contact with the underside of intensifier piston 82 to lessen the effects of a possible misalignment. In addition, plunger 84 is preferably symmetrical about three orthogonal axes such that fuel injector 14 can be more easily assembled by inserting either end of plunger 84 into the plunger bore located within injector body 61. When intensifier piston 70 is undergoing its downward pumping stroke, fuel within fuel pressurization chamber 90 is raised to injection pressure levels. Any fuel that migrates up the side of plunger 84 is preferably channeled back for recirculation via a plunger vent annulus and a vent passage 92. Pressure intensifier 70 is driven downward when flow control valve 72 connects actuation fluid passages 80/81 to high pressure actuation fluid inlet 60. Between injection events, flow control valve 72 connects actuation fluid passages 80/81 to low pressure drain 62 allowing the intensifier 70 to retract toward its retracted position, as shown, via the action of return spring 83 and fuel pressure acting on the underside of plunger 84. Thus, when pressure intensifier 70 is retracting, fresh fuel is pushed into fuel pressurization chamber 90 past check valve 93 via fuel inlet 64.

Figure 4:
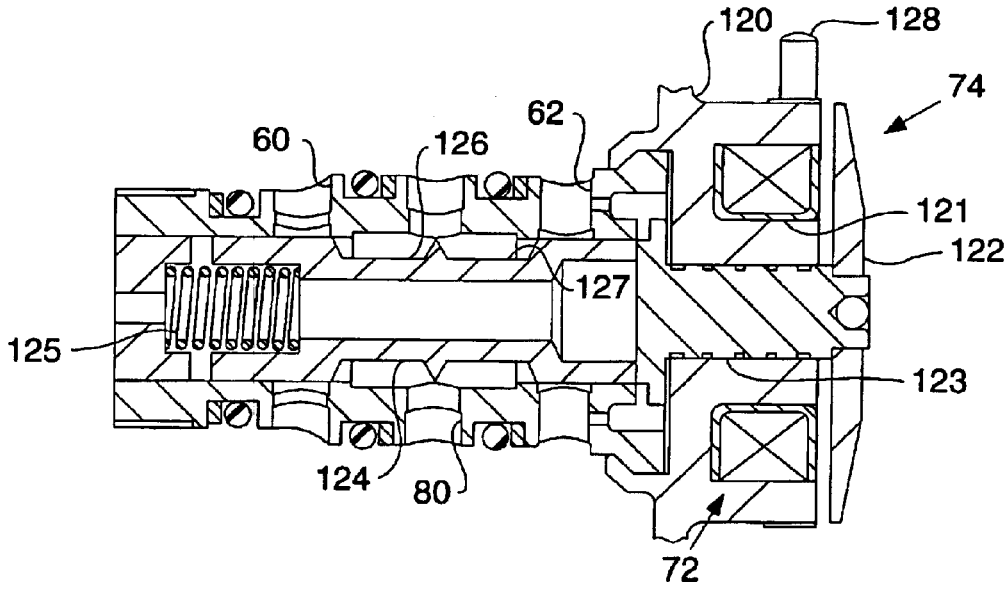
FIG. 4 is a sectioned side diagrammatic view of a flow control valve for the fuel injector of FIGS. 2 and 3.

Referring in addition to FIG. 4, flow control valve 74 includes an electrical actuator 72, which in the illustrated embodiment is a solenoid, but could equally be any other suitable electrical actuator known in the art including, but not limited to, piezos, voice coils, etc. Flow control valve 74 includes a valve body that includes separate passages connected to actuation fluid inlet 60, actuation fluid drain 62 and actuation fluid passages 80/81, respectively. Flow control valve 74 includes a spool valve member 124 biased via a biasing spring 125 to a first position that fluidly connects an actuation fluid passage 80/81 to actuation fluid drain 62. When electrical actuator 72 is energized, an armature 122 moves toward coil 121. This movement causes a pushpin 123 to push spool valve member 124 away from coil 121 to compress biasing spring 125 toward a second position. At this energized position, spool valve member 124 closes the fluid connection between actuation fluid passage 80/81 and drain 62, and opens high pressure inlet 60 to actuation fluid passages 80/81. These fluid connections are facilitated via respective high pressure annuluses 126 and 127 formed on the outer surface of spool valve member 124. Control communication line 41 of FIG. 1, electronic control module 22, and electric terminals 128 that are attached to valve body 120 are electrically connected to coil 121 in a conventional manner.

When pressure intensifier 70 is driven downward, high pressure fuel in fuel pressurization chamber 90 can flow via nozzle supply passage 107 to the nozzle chamber 105, and out of nozzle outlets 104 if direct control needle valve 79 is in an open position. When direct control needle valve 79 is in its closed position as shown, nozzle chamber 105 is blocked from fluid communication with nozzle outlets 104. Direct control needle valve 79 includes a needle valve member made up of a needle portion 112 separated from a piston portion 109 by a lift spacer 106. Thus, the needle valve member in this embodiment is made up of several components for ease of manufactureability and assembly, but could also be manufactured from a single solid piece. The needle valve member includes an opening hydraulic surface 103 exposed to fluid pressure in nozzle chamber 105 and a closing hydraulic surface 101 exposed to fluid pressure in a needle control chamber 100. The thickness of lift spacer 106 preferably determines the maximum opening travel distance of direct control needle valve 79. The direct control needle valve 79 is biased toward its downward closed position, as shown, by a biasing spring 102 that is compressed between lift spacer 106 and a VOP (valve opening pressure) spacer 108. Thus, the valve opening pressure of the direct control valve 79 can be trimmed at time of manufacture by choosing an appropriate thickness for VOP spacer 108. Needle control chamber 100 is fluidly connected to either low pressure fuel inlet 64 or to nozzle supply passage 107 depending upon the positioning of needle control valve assembly 76. When needle control chamber 100 is fluidly connected to nozzle supply passage 107, direct control needle valve 79 will remain in or move toward its closed position, as shown, under the action of fluid pressure forces on closing hydraulic surface 101 and the spring force from biasing spring 102. When needle control chamber 100 is fluidly connected to fuel inlet 64, while nozzle passage 107 and hence nozzle chamber 105 are above a valve opening pressure, the fluid forces acting on opening hydraulic surface 103 are sufficient to lift the direct control needle valve 79 upward towards its open position against the action of biasing spring 102 to open nozzle outlets 104.

Figure 6:
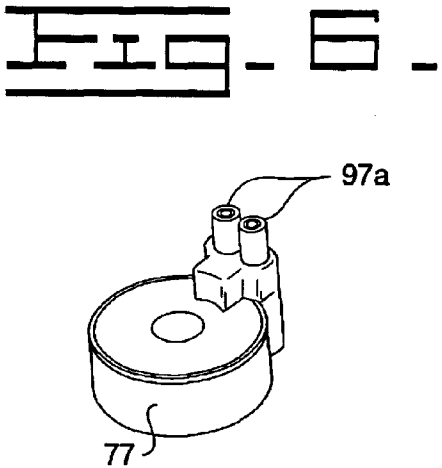
FIG. 6 is an isometric view of an electrical actuator subassembly for the needle control valve shown in FIG. 5.
Figure 5:
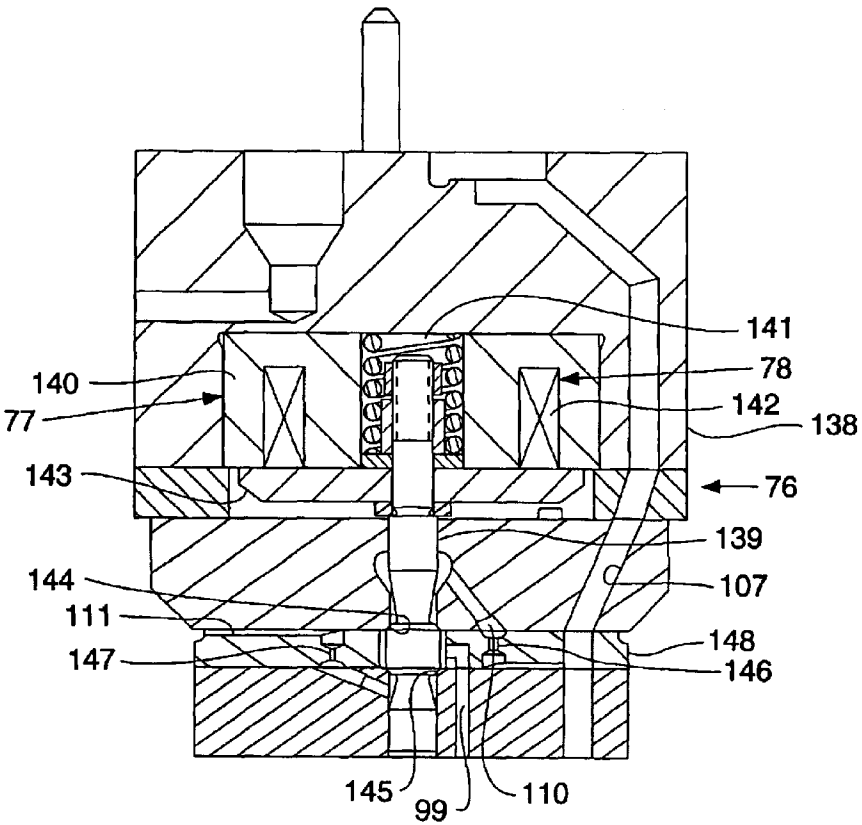
FIG. 5 is a sectioned side view of the needle control valve assembly from the fuel injector of FIGS. 2 and 3.

Referring in addition to FIGS. 5 and 6, the inner workings of needle control valve 76 are illustrated. Valve assembly 76 includes a valve body 138 which defines a portion of nozzle supply passage 107, a connection passage 110, a low pressure passage 111 and a needle control passage 99. The valve assembly 76 is a two position three way valve that includes a needle control valve member 139 that is moveable between contact with a high pressure seat 144 and a low pressure seat 145. Depending upon the position of valve member 139, needle control passage 99, which is fluidly connected to needle control chamber 100 (FIGS. 2 and 3), is fluidly connected to nozzle supply passage 107 via connection passage 110 or to fuel inlet 64 via low pressure passage 111. Needle control valve assembly 76 includes a second electrical actuator 78 which in the illustrated embodiment is a solenoid subassembly 77, but could also be another type of electrical actuator, such as a piezo, a voice coil, etc. The solenoid subassembly 77 includes a stator 140, a coil 142 and a pair of female electrical socket connectors 97 that are electrically connected to coil 142. The female electrical socket connection 97, which could instead be male, permits an electrical extension 96 to mate with solenoid subassembly 77 within injector body 71 while providing exposed terminals for insulated conductors 95 outside of upper portion 66. Valve member 139 is biased downward to close low pressure seat 145 by a biasing spring 141 via an armature 143 that is attached to valve member 139. When coil 142 is energized, armature 143 is lifted upward causing valve member 139 to open low pressure seat 145 and close high pressure seat 144. Because the flow area is past seats 144 and 145 effect the performance of the fuel injector 14, such as by effecting the opening and/or closing rate of direct control valve 79, flow restrictions 146 and 147 are included. In particular, flow restriction 146, which is preferably manufactured in an orifice plate 148 as a flow area that is restrictive relative to the flow area past seat 144. Likewise, flow restriction orifice 147 preferably has a flow area that is restricted relative to the flow past low pressure seat 145. Because these respective orifices 146 and 147 are based upon simple bore diameters rather than a clearance area between two separate moving parts, the performance between respective fuel injectors can be made more uniform. Furthermore, because these features are machined in a single orifice plate 145, the manufacturerability and assembly of needle control valve assembly 76 can be improved.

Figure 7:
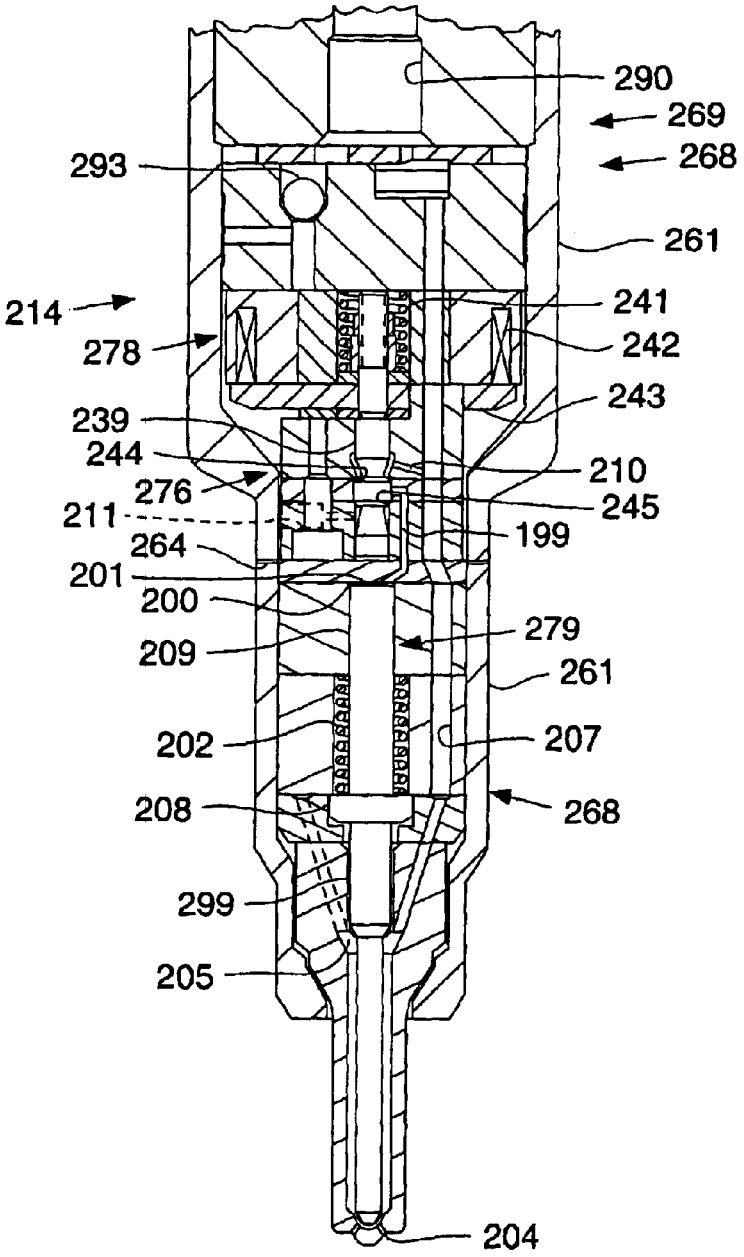
FIG. 7 is a partially sectioned side diagrammatic view of a fuel injector according to another embodiment of the present invention.

Referring now to FIG. 7, a fuel injector 214 according to another embodiment of the present invention includes an injector body 261 with a lower portion 268 that could be used in conjunction with the upper portion 61 of fuel injector 14 shown in FIGS. 2 and 3. This lower portion 268 differs from lower portion 68 in that it includes a reduced diameter portion that effects the structure of needle control valve 276. Like the earlier embodiment, lower portion 268 includes a direct control nozzle assembly 269 which includes a direct control needle valve 279 and a needle control valve 276. Like the earlier embodiment, direct control needle valve 279 includes a needle valve member that includes a needle portion 299 separated from a needle piston portion 209 by a VOP spacer 208. Needle portion 299 includes a opening hydraulic surface exposed to fluid pressure in a nozzle chamber 205 that is fluidly connected to nozzle outlets 204 when direct control needle valve 279 is lifted to an upward open position. When in such a position, fuel pressurization chamber 290 is fluidly connected to nozzle outlet 204 via nozzle supply passage 207 and nozzle chamber 205. Direct control needle valve 279 is preferably biased to a downward closed position by a biasing spring 202. Depending upon the positioning of needle control valve 276, needle control chamber 200 is fluidly connected via needle control passage 199 to either nozzle supply passage 207 via connection passage 210 or to fuel inlet 264 via low pressure passage 211. Direct control needle valve 279 includes a closing hydraulic surface 201 exposed to fluid pressure in needle control chamber 200. When the plunger for fuel injector 214 is undergoing its upward retracting stroke, fuel pushes open check valve 293 to refill fuel pressurization chamber 290 for a subsequent injection sequence. The needle control valve 276 includes a needle control valve member 239 that is moveable by an electrical actuator 278 between a low pressure seat 245 and a high pressure seat 244. Electrical actuator 278 includes a coil 242, a biasing spring 241 and an armature 243 attached to valve member 239. Armature 243, in this embodiment, is preferably a wagon wheel shaped armature such that a body component that includes a portion of nozzle supply passage 207 protrudes through the arms of the armature wagon wheel to provide for fluid communication and permit the reduced diameter shown.

Figure 8:
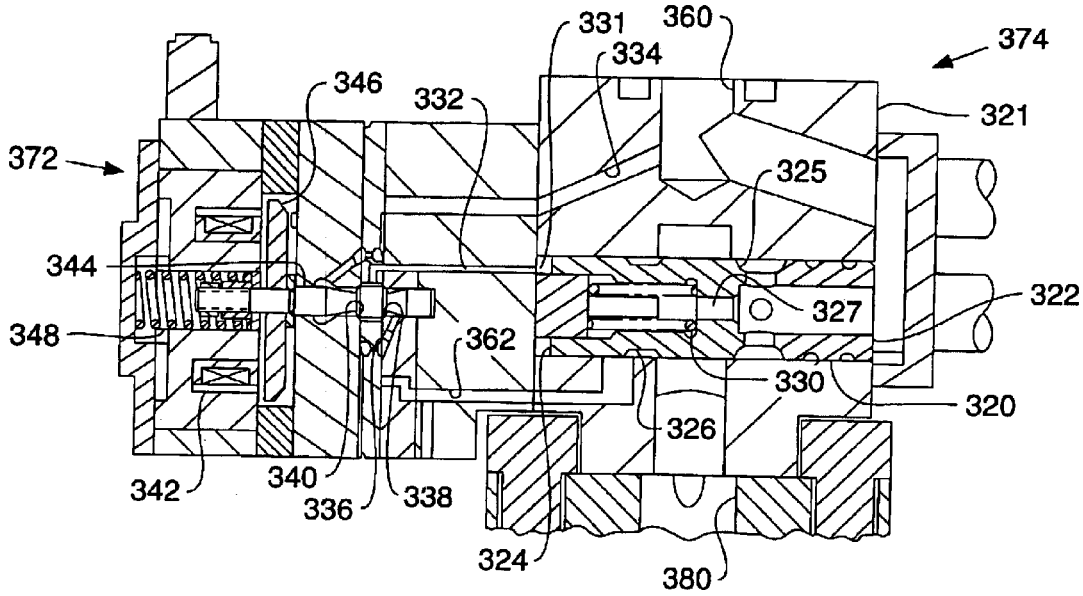
FIG. 8 is a sectioned side diagrammatic view of a flow control valve assembly according to another aspect of the present invention.

Referring now to FIG. 8, a flow control valve assembly 374 according to another embodiment of the present invention could be substituted in place of the flow control valve assembly 74 shown in FIGS. 2–4. Unlike the single stage valve assembly 74 shown in FIGS. 2 and 3, flow control valve assembly 374 includes a pilot valve assembly 372 which controls flow via controlling the positioning of a spool valve member 320. Like the earlier embodiment, flow control valve assembly 374 includes a valve body 321 that includes a top surface with an actuation fluid inlet 360, an actuation fluid drain 362, and an actuation fluid passage 380. Spool valve member 320 includes a biasing hydraulic surface 322 always exposed to fluid pressure inlet 360, and a control hydraulic surface 324 exposed to fluid pressure in a pressure control chamber 331. Hydraulic surfaces 322 and 324 are preferably about equal in effective area such that spool valve member 320 is substantially hydraulically biased when the fluid pressure acting on the opposite ends is equal. This is facilitated by spool valve member 320 including a pressure communication passage 327. Spool valve member 320 also includes a low pressure annulus 326 that connects actuation fluid passage 380 to actuation fluid drain 362 when spool valve member 320 is biased to its drain position, as shown, by biasing spring 330. When pressure in control chamber 331 is low, fluid pressure on surface 322 moves spool valve member 320 to its actuation position compressing spring 330 and moving annulus and radial passages 325 to communicate fluid from actuation fluid inlet 360 to actuation fluid passage 380. At the same time, annulus 326 moves out of registry with actuation fluid passage 380.

Pressure in control chamber 331 is controlled by pilot valve assembly 372. Pilot valve assembly 372 includes a pilot valve member 344 that moves between a high pressure seat 340 and a low pressure seat 338. When pilot valve member 344 is closing low pressure seat 338, pressure control chamber 331 is fluidly connected to actuation fluid inlet 360 via pressure communication passage 332 and branch passage 334. Pilot valve member 344 is biased to that position by a biasing spring 348. When the electrical actuator is energized, coil 342 attracts armature 346 and pilot valve member 344 to compress spring 348 and close high pressure seat 340. This fluidly connects pressure control chamber 331 to drain passage 362 via control passage 332 and vent passage 336.

Figure 9:
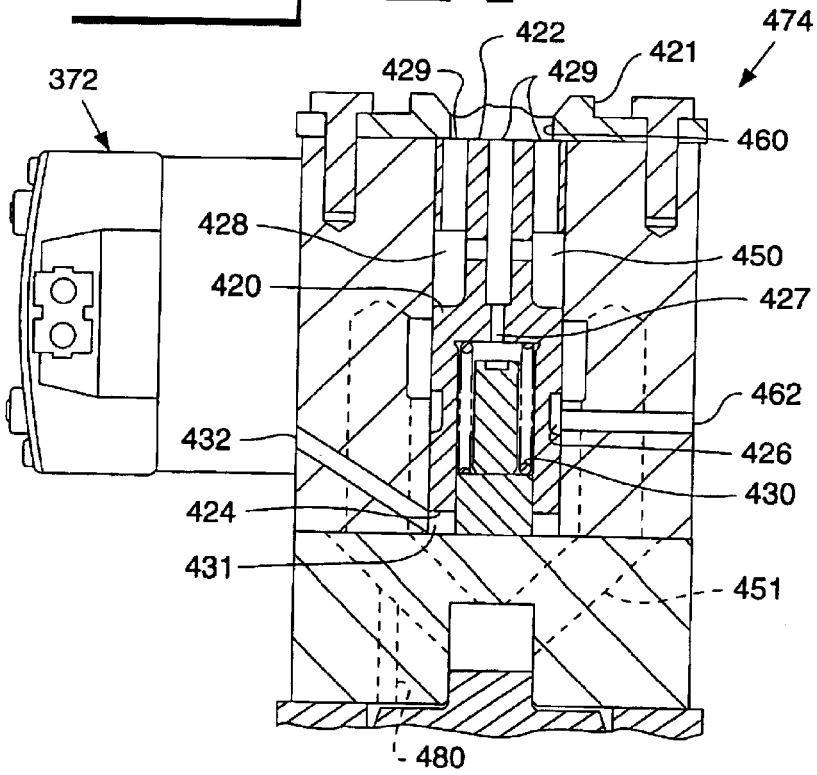
FIG. 9 is a partially sectioned side diagrammatic view of a flow control valve assembly according to still another aspect.

Referring now to FIG. 9, a flow control valve assembly 474 according to still another aspect of the present invention could be substituted in place of the flow control valve assembly 74 shown in FIGS. 2 and 3. This embodiment differs from the embodiment of FIG. 8 in that the spool valve member 420 is oriented vertically instead of horizontally as shown in FIG. 8. Flow control valve assembly 474 includes a pilot valve assembly 372 substantially identical to that shown in FIG. 8. Like the earlier embodiments, flow control valve assembly 474 includes a valve body 421 that includes a top surface with an actuation fluid inlet 460, and actuation fluid drain 462 and an actuation fluid passage 480. Spool valve member 420 includes a biasing hydraulic surface 422 always exposed to the high pressure of actuation fluid inlet 460 and a control hydraulic surface 424 exposed to fluid pressure in a pressure control chamber 431, which is connected to pilot valve assembly 372 via a pressure communication passage 432 similar to that shown in FIG. 8. Spool valve member 420 is normally biased to its upward position, as shown by a biasing spring 430 to connect actuation fluid passage 480 to actuation fluid drain 462 via low pressure annulus 426. When pilot valve assembly 372 connects pressure control chamber 431 to low pressure, spool valve member 420 moves downward to close the actuation fluid drain 462, and open actuation fluid passage 480 to actuation fluid inlet 460 via vertical passages 429 and annulus 428. When high pressure exists in pressure control passage 431. Spool valve member 420 is preferably hydraulically balanced via the respective surface areas 422 and 424 as well as the balancing effect provided by pressure communication passage 427.

INDUSTRIAL APPLICABILITY

Each engine cycle can be broken into an intake stroke, a compression stroke, a power stroke and an exhaust stroke. During each engine cycle, each fuel injector 14 has the ability to inject up to five or more discrete shots per engine cycle. While a majority of these injection events will take place at or near the transition from the compression to power strokes, injection events can take place at any timing during the engine cycle to produce any desirable effect. For instance, an additional small injection event elsewhere in the engine cycle might be useful in reducing undesirable emissions. During each engine cycle, a number of basic steps are performed to inject fuel, and each of those acts is performed at a timing and in a number to produce a variety of fuel injection sequences, which include one or more injection events.

Among the steps performed at least once each engine cycle in each portion of the injection system (e.g., fuel injector) for each engine cylinder is the step of positioning a needle control valve 76, 276 in a position that fluidly connects the needle control chamber 100, 200 to the fuel pressurization chamber 90, 290, and fluidly blocks the needle control chamber 100, 200 to the low pressure passage 111, 211. In the illustrated embodiment, that is accomplished by biasing the needle control valve member 139, 239 into contact to close a low pressure seat 145, 245 by a spring 141, 241. The valve 139, 239 could be biased in the other direction and operate in a manner opposite to that described with regard to the illustrated embodiments. In all cases, that act is performed by a three way valve. With this configuration, the pressurization chamber 90 is only briefly connected to the fuel inlet 64 when the needle control valve member 139, 239 is moving between low pressure seat 145, 245 and the high pressure seat 144, 244. Between injection events when pressure in fuel pressurization chamber 90, 290 is relatively low, very little leakage occurs past needle control valve assembly 76, 276. In addition, little leakage occurs during each injection event since the respective high pressure seats 144, 244 are closed. When the needle control chamber 100, 200 is fluidly connected to the fuel pressurization chamber 90, 290 and blocked from the low pressure passage 111, 211, no fuel injection takes place. In other words, when that occurs, direct control needle valve 79, 279 is preferably held in or moved toward its downward closed position, as shown.

Another act that is performed at least once during each engine cycle includes increasing fuel pressure within the fuel pressurization chamber 90, 290 at least in part by moving the flow control valve 74, 274, 374, 474 to a first position. The first position described is preferably the position at which valve 74, 274, 374, 474 opens actuation fluid inlet 60, 260, 360, 460 to actuation fluid passage 80, 280, 380, 480. In the case of the embodiments shown in FIGS. 8 and 9, energization of pilot valve assembly 372, 472 causes the spool valve member 320, 420 to connect actuation fluid inlet 360, 460 to actuation fluid 380, 480. When this step is performed, high pressure actuation fluid pushes down onto the intensifier piston 82, which compresses fuel in fuel pressurization chamber 90, 290 to injection levels.

Another act that is performed at least once each engine cycle, and in some cases many times per engine cycle, includes moving the needle control valve 76, 276 to a second position that fluidly connects the needle control chamber 100, 200 to the low pressure passage 111, 211, and fluidly blocks the needle control chamber 100, 200 to the fuel pressurization chamber 90, 290. This act is accomplished at least in part by supplying electrical energy to a direct control nozzle assembly 69. In the illustrated example, that includes supplying electrical energy to terminals 95 located outside the upper portion of fuel injector 14 and channeling that electricity via electrical socket connection 97 to electrical actuator 72, 278 located in the lower portion 68, 268 of the injector body 61, 161. When this occurs, needle control valve 39, 239 is lifted to close high pressure seat 144, 244 such that needle control chamber 100, 200 is fluidly connected to low pressure passage 111, 211. If fuel pressure in nozzle chamber 105, 205 is above a valve opening pressure, the direct control needle valve 79, 279 will move to, or stay in, an open position that fluidly connects fuel pressurization chamber 90, 290 to nozzle outlet 104, 204 via nozzle supply passage 107, 207. If fuel pressure is below a valve opening pressure, the direct control needle valve 79, 279 will move toward, or stay in, its biased closed position due to the action of biasing spring 102, 202 being the dominant force.

Another step that occurs at least once each engine cycle includes decreasing fuel pressure in the fuel pressurization chamber 90, 290 at least in part by moving a flow control valve 74, 274, 374, 474 to a position that fluidly connects the actuation fluid passage 80, 280, 380, 480 to the actuation fluid drain 62, 262, 362, 462. In the illustrated embodiments, this is the act that allows the fuel injector 14, 214 to reset itself for a subsequent injection sequence. When this step occurs, intensifier piston 82 and plunger 84 will retract upward toward their retracted positions as shown, under the respective actions of return spring 83 and fuel pressure in fuel pressurization chamber 90, 290. In all of the illustrated embodiments, this act is accomplished by ending electrical energy to actuator 72, 278, 372, 472 in order to allow flow control valve 74, 274, 374, 474 to return to its biased position that opens actuation fluid drain 62, 262, 362, 462.

Each of these steps is performed a number of times and at particular timings to produce a wide variety of injection event profiles. FIGS. 10*a–g* show a sampling of different needle control valve current stands to produce the injection sequences illustrated in FIGS. 11*a–g*, respectively. These injection rate shapes include boot+post, FIG. 11*a*; ERS (electronic rate shaping)+post, FIG. 11*b*; ramp+post, FIG. 11*c*; square+post, FIG. 11*d*; pilot+ramp+post, FIG. 11*e*; pilot+square+post, FIG. 11*f*; and, two pilot+square, FIG. 11*g*. Whether the front end takes on the shape of a boot, ramp or a square is related in the illustrated embodiment with the relative timing of opening the actuation fluid passage 80 to high pressure flow from the rail and the step of relieving pressure in needle control chamber 100, 200.

The system produces various front end rate shapes including square, ramp, a boot or even an electronic rate shape that lies somewhere between a boot and a ramp, via the timing in actuating flow control valve 74, 374, 474 relative to needle control valve 76, 276. The relative timing of the actuators associated with these two valves, along with the fact that the intensifier piston 82 includes a stepped top, allows for a variety of front end rate shapes. In order to produce a boot shaped front end of the type shown in FIG. 11*a*, needle control valve 76, 276 is actuated at about the same time as flow control valve 74, 374, 474. By doing so, the closing hydraulic surface 101, 201 of direct control needle valve 79, 279 is exposed to low pressure passage 111, 211 before the fuel pressure in fuel pressurization chamber 90, 290 is above valve opening pressures. Thus, in order to maximize a boot front end, the needle control valve 76, 276 should be actuated before the fuel pressure in fuel pressurization chamber 90, 290 is above valve opening pressures. When this occurs, the full affect of the top hat of intensifier piston 82 is exploited. In other words, the intensifier piston's 82 initial downward movement is relatively slow since high pressure is mostly acting only via actuation fluid passage 80 on the central small area portion of intensifier piston 82. The flow of fluid to the annular shoulder portion of intensifier piston through passage 81 is relatively restricted so that the hydraulic force on the annular shoulder is lower than the hydraulic pressure force acting on the central top hat portion of intensifier piston 82. The length of the toe of the boot shape is determined by the height of the central top hat portion of intensifier piston 82. In other words, when the central top hat portion clears its counter bore in passage 80, high pressure can act over the entire top surface of intensifier piston 82 causing its movement to accelerate and injection pressures to go up (the instep of the boot). Thus, when producing a boot shaped front end, direct control needle valve 79, 279 is set to behave like an ordinary spring biased check valve, and the rate shape is influenced by the top hat geometry of the intensifier piston along with the relative flow areas of actuation fluid passages 80 and 81.

When a square shaped front end is desired, the actuation of needle control valve 76, 276 is delayed relative to that of flow control valve 74, 374, 474. In other words, the flow control valve opens, and high pressure acts on the top of intensifier piston 82 causing it to move slightly downward to compress fuel in fuel pressurization chamber 90, but direct control needle valve 79, 279 remains in its downward closed position due to the force of high pressure fuel acting on closing hydraulic surface 101, 201. The slight movement of intensifier piston 82 and plunger 84 downward reflects the compressibility of the fuel in fuel pressurization chamber 90 and nozzle supply passage 107. Because direct control needle valve 79, 279 is held closed, oil pressure acting on the top of intensifier piston 82 is relatively high in the central portion exposed to actuation fluid passage 80, as well as the annular should portion, which is supplied by relatively restricted passage 81. When needle control valve 76, 276 is finally actuated, high oil pressure is pushing on the entire top surface of intensifier piston 82, and fuel in fuel pressurization chamber 90 is already at pressures that are well above the valve opening pressure of direct control needle valve 79, 279. As a result, when direct control needle valve 79, 279 moves to its open position, the injection rate goes from zero to near its maximum rate in a very short amount of time, as reflected in the square front end rate shape shown in FIG. 11*d*. Thus, the effect of the piston's top hat can be virtually negated to produce a square front end rate shape by delaying the activation of needle control valve 76, 276 until after fuel pressure within the injector is well above valve opening pressure, and approaching its maximum injection pressure level at that rail pressure.

The ramp shaped front end and the electronic rate shaping (ERS) front end illustrated in FIGS. 11*c* and 11*b*, respectively, are accomplished by activating needle control valve 76, 276 at a location in between that which would produce a boot shaped front end and that which would produce a square shaped front end. In other words, direct control needle valve 76, 276 is activated at a timing that will take some advantage of the piston's top hat but not the entire potential effect of the same. Thus, with appropriate timing of the activation of needle control valve 76, 276 relative to that of flow control valve 74, 374, 474 a continuity of different front and rate shapes ranging from a boot to a square can be accomplished through electronic control independent of engine speed and load.

The present invention also affords the possibility of performing rear end rate shaping in a manner very similar to the front end rate shaping. The present system allows the idea that main injection events should terminate as abruptly as possible to be revisited. It might be desirable in some instances, to produce a gradually decreasing flow rate at the end of an injection event in contrast to the relatively abrupt endings illustrated in FIG. 11*a–g*. Again, like front end rate shaping, this is accomplished by the relative timing in the deactivation of needle control valve 76, 276 relative to that of flow control valve 74, 374, 474. At one extreme of this procedure, needle control valve 76, 276 is deactivated before, or at about the same time as, flow control valve 74, 374, 474. By doing so, direct control needle valve 79, 279 is abruptly shut, even though fuel pressurization chamber 90, 290 is at a relatively high pressure levels. Thus, when this strategy is employed, a relatively abrupt injection ending occurs. At another extreme, needle control valve 76, 276 is deactivated well after that of flow control valve 74, 374, 474 such that direct control needle valve 79, 279 is closed under the action of its biasing spring, 102, 202 without any substantial hydraulic assistance acting on closing hydraulic surface, 101, 201. Thus, in this extreme, the closing procedure of direct control needle valves 79, 279 is much like that of a conventional spring biased check, in that the needle closes when fuel pressure drops below a valve closing pressure which is determined by the pre-load of biasing spring 102, 202. Between these two extremes a variety of different end rate shapes can be produced. For instance, the needle control valve 76, 276 can be deactivated after deactivation of flow control valve 74, 374, 474 such that fuel pressure levels have dropped within the fuel injector, but the deactivation occurs before fuel pressure has dropped below valve closing pressure. In such a case, there would be some gradual reduction in injection flow rate at the end of the injection event followed by an abrupt closure. Thus, those skilled in the art will recognize that some substantial amount of rate shaping flexibility is available by controlling the relative timing of the deactivation of flow control valve 74, 374, 474 relative to the deactivation of needle control valve 76, 276. Reasons for end of injection needle "rate control" could include a potential lowering of hydrocarbon emissions along with the durability benefits of reduced needle impact forces.

With regard to pilot injections, the present invention has the capability of reliably and consistently producing relatively small injection amounts. In addition, the fuel injection system has the ability to control whether those pilot injections occur at higher or lower pressures. This again is accomplished by the relative timing of the activation of flow control valve 74, 374, 474 relative to the activation of needle control valve 76, 276. In other words, if the pilot injection is desired to occur at a relatively lower injection pressure, flow control valve 74, 374, 474 and needle control valve 76, 276 are actuated close in time to take advantage of the lower initial injection pressures afforded by the slower initial movement of intensifier piston 82 due to its top hat design. In such a case, the pilot injection amount is often so small that needle control valve 76, 276 is deactuated well before the top hat of intensifier piston 82 clears its counter bore. Thus, the pressure at which the pilot injection occurs is influenced by the relative timing of actuation of the flow control valve relative to the needle control valve, but the quantity of fuel injected is still tightly controlled by the actuation duration of needle control valve 76, 276. In the event that the pilot injection is desired to occur at relatively higher injection pressures, the actuation of needle control valve 76, 276 is delayed relative to that of flow control valve 74, 374, 474 in a manner similar to that described with respect to producing a square front end rate shape. In other words, fuel pressure is allowed to rise to levels well above valve opening pressure before needle control valve 76, 276 is actuated. Improved quantity control may be realized in this mode.

The fuel injection system of the present invention also has the ability to combine pilot injections with a variety of front end rate shapes. This again is accomplished by the relative timing in the actuation and deactuation of needle control valve 76 relative to the actuation, and possible deactuation, of flow control valve 74, 374, 474. For instance, these relative timings can be utilized to produce the pilot+ramp and pilot+square injection rate shapes shown in FIGS. 11*e* and 11*f*, respectively. The closer in time that the pilot injection event occurs to the starting of the main injection event, the less flexibility the fuel injection system has in controlling both the injection pressure of the pilot and the front end rate shape of the main injection event independent of one another. On the other hand, if the dwell between the pilot injection event and the main injection event is sufficiently long in duration, the fuel injector may actually have sufficient time to deactivate flow control valve 74, 374, 474 between the pilot and main injection events in order to allow for more independent control of the pilot injection pressure relative to the front end rate shape of the main injection event. When the pilot injection quantities are relatively small, the injection event can occur so quickly that direct control needle valve 79, 279 only has time to partially open before it again is hydraulically pushed shut. The ability to consistently produce small injection quantities, even when the direct control needle valve 79, 279 does not go completely open, is accomplished by the relatively fast moving needle control valve 76, 276 that does move completely between its upper and lower seats, even during a small quantity pilot injection event.

The fuel injection system of the present invention also has the capability of producing relatively small post injection events with dwell times from the end of the main injection event under 500 micro seconds; the illustrations show about 350 micro seconds. Like front end rate shaping, the fuel injector also has the ability to do some rear end rate shaping and control whether the post injection is done at a relatively high or low injection pressure level. This again is controlled by the relative timing of the activation and deactivation of needle control valve 76, 276 relative to the deactuation timing of flow control valve 74, 374, 474. For instance, if a close in time post injection of the type shown in FIGS. 11*a*–11*f* is desired, the needle control valve 76 is deactuated to end the main injection event, and then a short time later is actuated and then deactuated again to produce the post injection event. The flow control valve 74, 374, 474 is deactuated at around the time that the needle control valve 76, 276 is deactuated to end the post injection event. If the post injection event is desired to occur at a relatively lower injection pressure, the flow control valve 74, 374, 474 is deactuated at some timing before needle control valve 76, 276 is actuated to begin the post injection event. In other words, the fuel pressure is allowed to drop in the injector before the post injection event is initiated. This permits a main injection event at a relatively high injection pressures followed by a post injection event at a lower injection pressure level. In addition, the relative timings of actuation and deactuation of flow control valve 74, 374, 474 relative to needle control valve 76, 276 can allow for some rear end rate shaping in tandem with some independent control over the injection timing and pressure of a post injection event.

All of these proceeding front end rate shaping, rear end rate shaping strategies, post injections, pilot injections can all be combined in different combinations to produce a very wide variety of injection sequences that include one or more injection events with a variety of rate shapes, quantities, and dwells. In addition, these injection characteristics can be controlled with some substantial independence from one injection to another within a given injection sequence. This capability allows the fuel injection strategy at each engine speed and load to be tailored to produce some particular effect, such as reduced emissions.

Figure 12:
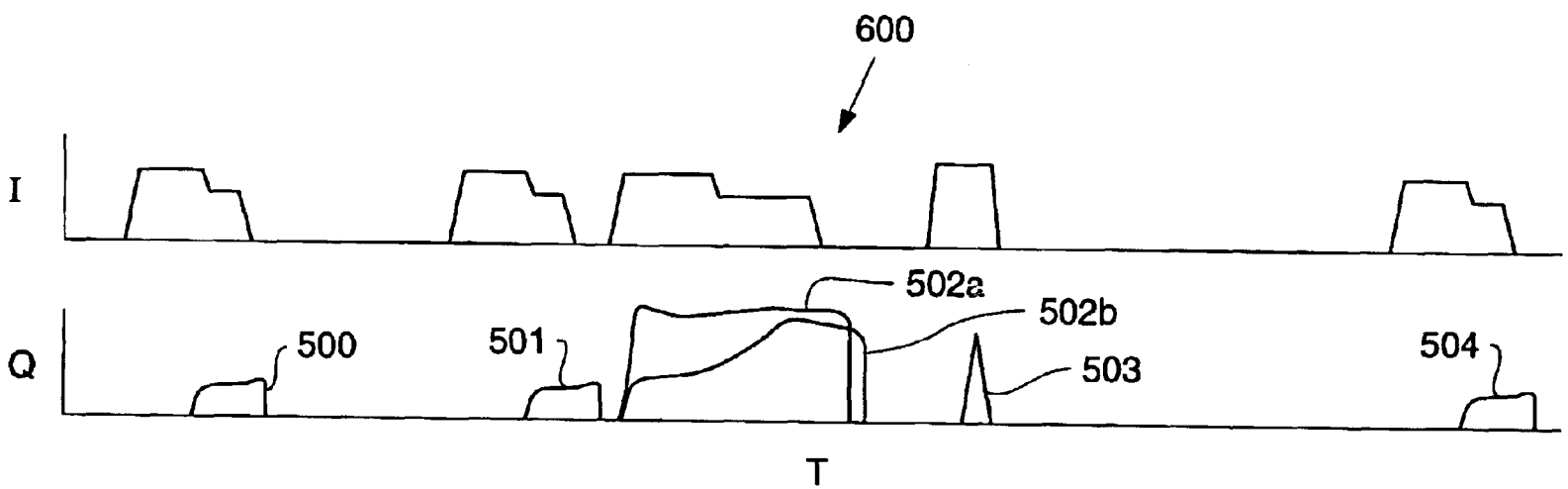
FIG. 12 are graphs of fuel injection control signal and fuel injection rate verses time according to another aspect of the present disclosure.

Referring to FIG. 12, all of the previously described capabilities of the fuel injection system of the present invention allow for a full featured injection sequence strategy that may drastically reduce undesirable emissions from an engine. This strategy could include an early pilot injection 500, preferably between forty and sixty degrees before top dead center of the compression stroke. This early pilot is followed by a main delay, which may be long enough for the fuel injector 14 to reset itself before the pilot injection 501 that occurs shortly before the main injection event. Again, as discussed earlier, this main injection event can have a variety of front and rear end rate shapes, including a square main injection 502*a* or a ramp/boot main injection event 502*b*. This main injection event is followed by a brief post delay and a post injection event 503. After some substantial late post delay, which could afford the injector the ability to reset itself and return to low pressure before a late post injection event 504 that could occur near top dead center of the exhaust stroke. The control signal waveform 600 is shown above the illustrated full featured injection sequence. When this injection sequence strategy is employed along with the ability to tightly control quantities, timings, rate shapes and dwells, substantial reductions in undesirable engine emission can be accomplished with great flexibility and efficiency. FIG. 12 only shows the electronic wave form 600 for the needle control valve 76, 276 along with the injection rate that is produced. In the illustrated example, the wave form for the flow control valve 74, 374, 474 is similar but slightly longer in duration than the illustrated wave form for needle control valve 76, 276; however, this is tempered by the previous discussion regarding the relative timings of the actuation and deactuation of the flow control valve relative to the needle control valve to produce the rate shaping effects discussed earlier.

Although the illustrated embodiments show fuel injectors having separate actuation fluid inlets from fuel inlets, some aspects of the present invention are directly applicable to systems, such as Bosch APCRS, in which the fuel and actuation fluid inlets are one in the same. Because fuel pressure between injection events is usually low and because the fuel pressurization chamber 90, 290 is blocked from the actuation fluid inlet 64 while injecting, the illustrated system can achieve leakage rates less than about 50 cubic millimeters per injection event. The illustrated embodiment produces a leakage rate of about 30 cubic millimeters per injection event per engine cycle, or about 15 $mm^3$ per movement of valve member 139, 239. This leakage occurs over that brief instant when the fuel pressurization chamber 90, 290 is directly connected to the low pressure passage 111, 211 as the valve member 139, 239 moves between seats. Because of the quick action of needle control valve 76 with direct control needle valve 79, the system can achieve dwell times less than about 500 micro seconds between a pilot and/or post with a main injection event. The illustrated can achieve dwell times of about 350 microseconds for a small post injection with a high degree of accuracy and consistency. In addition, these small injection events, including small splitting injection events at idle can be produced reliably and consistently with low volumes less than about six cubic millimeters. For instance, a combined total split injection in about equal shots with combined volume of about 12–20 cubic millimeters at idle are achievable.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising:

an injector body having an upper portion and a lower portion;

a pressure intensifier movably positioned in said upper portion;

a flow control valve attached to said upper portion;

a direct control needle valve positioned in said lower portion;

an electrical actuator attached to said lower portion; and a three-way needle control valve positioned in said lower portion and operably coupled to said electrical actuator, and including a valve member trapped between a low pressure seat and a high pressure seat, and including a low pressure passage disposed therein that includes a flow restriction relative to a flow area past said low pressure seat.

2. The fuel injector of claim 1 wherein said upper portion includes a surface with an actuation fluid inlet therethrough.

3. The fuel injector of claim 1 wherein said injector body defines an actuation fluid inlet and a fuel inlet.

4. The fuel injector of claim 1 wherein said electrical actuator is a first electrical actuator; and including a second electrical actuator operably coupled to said flow control valve; and said flow control valve includes a spool valve member.

5. The fuel injector of claim 4 wherein said second electrical actuator includes an armature attached to said spool valve member.

6. The fuel injector of claim 4 wherein said flow control valve includes a pilot valve member; and said second electrical actuator includes an armature attached to said pilot valve member.

7. The fuel injector of claim 1 including a pair of electrical conductors with a portion exposed outside said upper portion and being electrically connected to said electrical actuator via a electrical socket connection at least partially located inside said injector body.

8. The fuel injector of claim 1 wherein said pressure intensifier includes a free floating plunger.

9. The fuel injector of claim 8 wherein said plunger is symmetrical about three orthogonal axes.

10. The fuel injector of claim 1 wherein said injector body includes an unobstructed vent passage disposed therein and extending between a piston return cavity and an outside of said injector body.

11. The fuel injector of claim 1 wherein said needle control valve includes a high pressure passage disposed therein that includes a flow restriction relative to a flow area past said high pressure seat.

12. The fuel injector of claim 1 wherein said pressure intensifier and said direct control needle valve are free of dynamic seals.

13. A fuel injection system comprising:

a plurality of fuel pressurization assemblies and direct control nozzle assemblies;

a pressure intensifier movably positioned in each said fuel pressurization assembly;

a flow control valve attached to each said fuel pressurization assembly;

a common rail fluidly connected to each said fuel pressurization assembly;

an electrical actuator attached to each said direct control nozzle assembly; and a three-way needle control valve positioned in each said direct control nozzle assembly and operably coupled to said electrical actuator, and including a valve member trapped between a low pressure seat and a high pressure seat, and including a low pressure passage disposed therein that includes a flow restriction relative to a flow area past said low pressure seat.

14. The system of claim 13 including a source of low pressure fuel;

said common rail contains a medium pressure actuation fluid; and each said fuel pressurization assembly defining an actuation fluid inlet fluidly connected to said common rail, and a fuel inlet fluidly connected to said source of low pressure fuel.

15. The system of claim 13 wherein each said fuel pressurization assembly is attached to a direct control nozzle assembly as a unit fuel injector.

16. The system of claim 13 wherein each said fuel pressurization assembly includes a surface with an actuation fluid inlet therethrough.

17. The system of claim 13 wherein said fuel pressurization assembly defines an actuation fluid inlet and a fuel inlet.

18. The system of claim 13 wherein said electrical actuator is a first electrical actuator; and includes a second electrical actuator operably coupled to said flow control valve; and said flow control valve includes a spool valve member.

19. The system of claim 18 wherein said second electrical actuator includes an armature attached to said spool valve member.

20. The system of claim 13 wherein said flow control valve includes a pilot valve member; and said second electrical actuator includes an armature attached to said pilot valve member.

21. The system of claim 13 including a pair of electrical conductors electrically connected to said electrical actuator via a electrical socket connection located at least partially inside said direct control nozzle assembly.

22. The system of claim 13 wherein said pressure intensifier includes a free floating plunger.

23. The system of claim 22 wherein said plunger is symmetrical about three orthogonal axes.

24. The system of claim 13 wherein said fuel pressurization assembly includes an unobstructed vent passage disposed therein and extending between a piston return cavity and an outside of said fuel pressurization assembly.

25. The system of claim 13 wherein said fuel pressurization assembly and said direct control nozzle assembly are free of dynamic seals.

26. A method of injecting fuel, comprising the steps of:

positioning a needle control valve in a first position that fluidly connects a needle control chamber to a fuel pressurization chamber and fluidly blocks said needle control chamber to a low pressure passage;

increasing fuel pressure within said fuel pressurization chamber at least in part by moving a flow control valve to a first position;

moving a needle control valve to a second position that fluidly connects said needle control chamber to a low pressure passage and fluidly blocks said needle control chamber to said fuel pressurization chamber at least in part by supplying electrical energy to a direct control nozzle assembly;

restricting fluid flow from said needle control chamber to the low pressure passage relative to a flow area past a low pressure seat; and decreasing fuel pressure within said fuel pressurization chamber at least in part by moving said flow control valve to a second position.

27. The method of claim 26 including a step of leaking less than 50 cubic millimeters of fuel from said direct control nozzle assembly per injection event.

28. The method of claim 26 wherein said increasing step includes supplying actuation fluid through a surface of a fuel pressurization assembly.

29. The method of claim 26 including a step of supplying fuel and an actuation fluid to separate inlets of a fuel pressurization assembly.

30. The method of claim 29 wherein said increasing fuel pressure step includes a step of supplying electrical energy to a fuel pressurization assembly.

31. The method of claim 26 including a step of retracting an intensifier piston at least in part by applying a spring force; and retracting a plunger at least in part by applying a hydraulic force.

32. The method of claim 26 including a step of venting a volume underneath an intensifier piston to outside a fuel pressurization assembly.

33. The method of claim 26 wherein the steps are performed in a number and sequence that produces up to five discreet injections per cylinder per engine cycle.

34. The method of claim 26 wherein the steps are performed in a number and sequence that produces a main injection accompanied by at least one of a pilot injection and a post injection with a dwell less than 500 micro seconds.

35. The method of claim 34 wherein said main injection includes at least one of a boot, a ramp and a square rate shape.

36. The method of claim 34 wherein said pilot injection has a volume less than or equal to about 10 cubic millimeters, and said post injection has a volume of about 15 cubic millimeters.

37. The method of claim 26 wherein the steps are performed by a unit injector.

38. The method of claim 26 wherein the steps are performed in a number and sequence to produce an idle split injection with a combined volume of 15–20 cubic millimeters in about equal shots.

* * * * *